United States Patent [19]

Jilla

[11] 4,204,290

[45] May 27, 1980

[54] PROCESS FOR THE RAPID, CONTINUOUS NOVEL TEXTURING OR TEXTILE MATERIALS AND NOVEL-TEXTURED TEXTILE MATERIALS

[76] Inventor: Dara A. Jilla, 5006 Crooked Oak La., Charlotte, N.C. 28211

[21] Appl. No.: 881,665

[22] Filed: Feb. 27, 1978

[51] Int. Cl.[2] ..... D06P 5/08; D06M 15/10; D06M 15/48; B32B 27/08

[52] U.S. Cl. ..... 8/478; 427/274; 427/276; 427/288; 8/480; 8/481

[58] Field of Search ..... 8/17, 14, 15, 65, 31, 8/100 R; 427/274, 276, 288; 28/243, 246

[56] References Cited

U.S. PATENT DOCUMENTS

| | | | |
|---|---|---|---|
| 1,792,277 | 2/1931 | Clifford | 427/276 |
| 1,992,259 | 2/1935 | Taylor | 8/14 |
| 2,933,409 | 4/1960 | Binkley et al. | 427/276 |
| 2,955,324 | 10/1960 | Morgan | 8/15 |
| 3,323,165 | 6/1967 | Mottern et al. | 28/243 |
| 3,402,987 | 9/1968 | Dalton et al. | 8/31 |
| 3,652,198 | 3/1972 | Farber et al. | 8/100 |
| 3,685,951 | 8/1972 | Tamer et al. | 8/31 |
| 3,949,124 | 4/1976 | Jilla | 427/390 B |
| 3,969,551 | 7/1976 | Ellsworth | 427/288 |
| 4,087,243 | 5/1978 | Thomas et al. | 8/31 |

FOREIGN PATENT DOCUMENTS

| | | | |
|---|---|---|---|
| 77471 | 5/1969 | Fed. Rep. of Germany | 8/14 |
| 43-7068 | 3/1968 | Japan | 8/17 |
| 45-27533 | 9/1970 | Japan | 28/246 |
| 1025463 | 4/1966 | United Kingdom | 427/286 |

*Primary Examiner*—Melvyn I. Marquis
*Assistant Examiner*—Maria S. Tungol
*Attorney, Agent, or Firm*—Richards, Shefte & Pinckney

[57] ABSTRACT

Novel-textured textile materials and the process of producing same by impregnating a substantially dry textile material with an inert solution of polymers at a relatively high temperature while the textile material is under tensile stress, the polymers being sufficiently inert as to have no substantial adverse effect upon the textile material undergoing impregnation, the polymer solution consisting of:

a. At least one phase of a copolymer of dimethyl terephthalate with a tetrol compound.

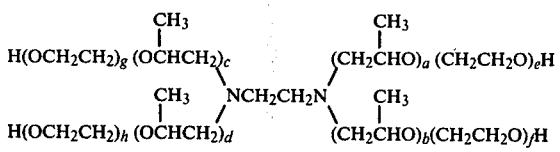

where a, b, c, d, e, f, g, and h are each integers and the total of a, b, c, and d is between 8 and 850 and the total of e, f, g, and h is between 8 and 1,000;

b. at least one phase of a compound which contains a cross-linkable polyester dispersed in a high boiling organic liquid selected from the class consisting of polyethylene and other polyalkylene glycols, and the methyl and ethylmono- and di-ethers of such glycols;

followed by quenching the impregnated textile material; then rinsing with a low boiling organic liquid, such as an alcohol, a ketone or an ether; and then exposing the material to dry heat at a relatively high temperature; thereby imparting novel, commercially attractive texture contour in the final textile material. Subsequent dyeing of the textured textile material results in additional unique, commercially attractive tone-on-tone or heather-look in the localized regions of the textile material which were subjected to the above-mentioned impregnation step.

8 Claims, No Drawings

PROCESS FOR THE RAPID, CONTINUOUS NOVEL TEXTURING OR TEXTILE MATERIALS AND NOVEL-TEXTURED TEXTILE MATERIALS

BACKGROUND OF THE INVENTION

This invention relates generally to imparting novel, commercially attractive textured contour or textured dyeing to textile materials. Various processes have been developed for these purposes with varying degrees of success. For example, textured contours are commonly provided by knitting, heat-setting and de-knitting, by the use of stuffer boxes, gear crimpers, and by various other conventional texturing machines; and textured dyeing is commonly obtained by warp printing, pad dyeing in a knit de-knit operation, package injection dyeing, and by various other conventional variagated dyeing operations.

In comparison with prior processes, the present invention provides a wide variety of results in a more effective manner with better quality at less production cost.

SUMMARY OF THE INVENTION

Accordingly, it is an object of this invention to provide a process for imparting novel, commercially attractive texture contour to textile materials. It is a further object of this invention to provide a process as aforesaid which is especially well adopted for rapid, continuous manufacturing. Yet another object is to provide novel-texture textile material produced from a textile material processed in the manner described hereinafter. Additional important objects and features of this invention will appear more fully as the description proceeds.

Briefly stated, the process of the present invention comprises impregnating a substantially dry textile material, dry padding, printing, cascading or spraying, with a solution of polymers sufficiently inert as not to have any substantial adverse effect upon the textile material undergoing impregnation and at a relatively high temperature. The impregnation step is followed by quenching the impregnated textile material, then rinsing it with a low boiling organic liquid, and then exposing it to dry heat at a relatively high temperature. In one form of the invention the impregnation step is followed by imposing a predetermined physical contour to the impregnated textile material, such as by gear crimping, while maintaining the aforesaid tensile stress, and before the aforementioned quenching step. Surprisingly, this combination of the impregnation step in conjunction with the contour imposing, quenching, rinsing and dry-heating steps causes novel texture contour in the final textile material. The result is commercially attractive and aesthetically beautiful texture contour of a wide range of form or shape obtained in the final textile material.

In another form of the invention the impregnation step is applied to selected portions of the textile material under tensile stress in a precise, controlled manner according to a predetermined program, whereas other portions of the yarn are not subjected to the impregnation step, followed by the aforementioned quenching, rinsing and dry-heating steps. Impregnation of the yarn may be varied in a precise controlled manner according to any predetermined program by means per se well known in the art.

It has been found that the aforementioned impregnation at controlled locations results in a localized thinning or reduction of denier of the material, which not only changes the physical appearance to provide an attractive varying thickness, but also surprisingly results in a localized change in dyeing affinity such that the portions of thinner denier take on a different dye tone than the unimpregnated thicker portions with a resulting attractive tone-on-tone or heather-like textured dyeing characteristic uniquely combined with the varying denier characteristic. Thus an aesthetically attractive textured dyeing and textured contour of a wide range of forms is obtained by the present invention.

DESCRIPTION OF THE PREFERRED EMBODIMENTS

Basically, the processes of the preferred embodiments of the present invention include the steps of impregnating a substantially dry textile material with an inert solution of polymers at a relatively high temperature while the textile material is under tensile stress, with the polymers being sufficiently inert as to have no substantial adverse effect upon the textile material undergoing impregnation, quenching the impregnated textile material, rinsing the quenched textile material with a relatively low boiling organic liquid, and then exposing the rinsed textile material to dry heat at a relatively high temperature.

The textile material may be in various forms, such as fiber, filament, continuous multi-filament, staple fiber or slit film yarn. It also may be woven, non-woven, knitted or tufted fabric. The textile material may be made of synthetic thermoplastics such as polyesters, polyacrylics, polyamides, polyimides, polypropylene, etc.; as well as fibers of natural origin such as wool and cotton; or the blends of synthetic thermoplastic material with fibers of natural origin.

The impregnation of the textile material while held under tensile stress, may be performed on the entire material or may be performed in a precise, controlled manner according to a predetermined program to selected localized portions. In either manner, the impregnation is performed by such known methods as padding with polished or matted finish metal rolls, fluted, grooved or gear rolls, or by cascading, printing or spraying.

In the preferred embodiment, the polymer solution used for impregnation consists essentially of:

a. at least one phase of a copolymer of dimethyl terephthalate with a tetrol compound having the general formula:

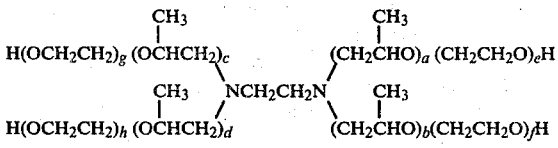

where a, b, c, d, e, f, g, and h are integers and the total of a, b, c, and d is between 8 and 850 and the total of e, f, g, and h is between 8 and 1,000;

b. at least one phase of a compound which contains a cross-linkable polyester dispersed in a high boiling organic liquid selected from the class consisting of polyethylene and other polyalkylene glycols, and the methyl and ethylmono- and di-ethers of such glycols.

Copolymers of dimethyl terephalate with tetrols are commercially available under the trade designation ES-7192, said copolymers having an average molecular weight of about 44,000, with the ethylene oxide moiety making up about 55 percent of the molecular weight. Also, tetrol compounds are commercially available under the trademark Tetronic as a series of poly(oxyethylene)-poly(oxyporpylene) block copolymers having molecular weights from about 1,650 to over 26,000.

Cross-linkable polyesters are commercially available under the trade designation Polyester Binders as series of compounds produced from suitable cross-linkable polyesters, such as e.g., reaction products of glycols, poly (ethylene glycol) or mixture thereof with dimethylsodiumsulfoisophthalic and dicarboxylic acids or mixtures thereof.

Suitable high boiling organic liquids selected from the class consisting of polyethylene glycols and polyalkylene glycol useful in the present invention are known compounds and are commercially available under the trademark Carbowax and Ucon lubricants, respectively.

The polymer solution is applied at a relatively high temperature, preferably between 150° C. and 230° C. (or in some cases as high as 250° C.) for a brief interval of time, usually less than 1 second, and more often of the order of 2 to 20 seconds or even 1 minute. This impregnation takes place while textile material is held under tensile stress in a precise, controlled manner, using conventional tensioning rolls or other mechanical tensioning devices of known application. This impregnation of the polymer solution at a relatively high temperature while the material is under tensile stress results in a heating of the textile material with the polymer solution serving as a carrier for wet heat or lubricated heat and being inert so as not to damage the material otherwise and with the heat and tensile stress resulting in a thinning of the material, such as the denier when treating textile yarns.

As mentioned, the impregnation step must be carried out at a relatively high temperature but not sufficiently high as to have any substantially adverse effect upon the textile material undergoing the impregnation, i.e., it must not have any detrimental effect thereon such as undue solubilizing, tackifying embrittling or tenderizing, or undue chemical reaction with dyestuffs or other textile treating agent to which the textile material might have been subjected prior to the processing of the present invention.

The quenching step is carried out in any known conventional manner and is intended simply to terminate the heating effect of the impregnation step.

The rinsing step that follows the quenching step utilizes a suitable low boiling organic liquid such as an alcohol, for example isopropanol, methanol, etc., a ketone, for example methyl ethyl ketone, acetone, etc., or an ether, for example isopropyl ether. This rinsing step effects substantially complete removal of the excess, unfixed polymer from the surface of the polymer-impregnated textile material. The subsequent dry heating step then ignites or flashes the low boiling organic liquid applied during the rinsing step and thus substantially completely removes the excess low boiling organic liquid from the surface of the material.

In one form of the present invention the textile material, after impregnation and before quenching, has a predetermined physical contour imposed either throughout its length or at programmed localized portions. This physical contour is imposed by the use of crimping rolls or any other conventional manner and imposes the crimp or other contour while the textile material is heated and under tensile stress. As a result, the physical contour is imparted permanently to the material and produces a physically textured product.

The material treated according to the present invention and with a physical contour imposed has a latent memory such that when subsequently tensioned to remove all or substantially all of the physical contour and to transform the material into what superficially appears to be its original form in which it is subjected to further textile processing, as winding, warping, weaving, knitting, tufting, dyeing, finishing, etc., will upon again be subjected to wet or dry heat regain or return to the textured contour initially imposed.

In another form of the present invention, the impregnation of the textile material with the polymer solution is performed in a precise, controlled manner according to a predetermined program using conventional applications and mechanisms such as those described above. This produces localized portions of impregnated material and other portions that are not so impregnated and as a result the material will have spaced portions of physically different texture characterized by the different deniers, and the unimpregnated sections will ultimately retain their initial characteristics rather than being transformed by the present process. Suprisingly, the difference in the characteristics of the impregnated sections in comparison with the unimpregnated sections results in a different dyeing affinity or characteristic between the two types of sections such that upon subsequent dyeing a unique, commercially attractive tone-on-tone or heather-look is obtained in fabrics produced with yarn that has been so processed. Thus, this form of the present invention includes the step of dyeing the textile material subsequent to the dry heating step. This dyeing can be a subsequent over-dyeing with an aqueous solution or printing paste of acid, disperse or cationic dyestuffs in such per se well known devices as winches, jigs, paddles, dyebecks, jets, package and beam dyeing machines, or continuous dyeing ranges currently in use.

The combination of thinning and different dyeing characteristics in the localized impregnated sections produces a unique effect not heretofore obtained in that the localized sections of thinner denier or the same sections that have a different dyeing characteristic and when fabrics are made from yarn processed in this manner a highly unique and attractive appearance results with fabric portions of thinner material and of different shade or tone.

Other methods of applying the principles of this invention may be employed instead of those specifically mentioned inasmuch as it will be apparent that obvious modification thereof may be made within the skill of the art. Without departing from the spirit of the invention and the scope of the appended claims. Without limiting my invention, therefore, the following examples are given to illustrate the details of application.

These examples include actual runs made on a pilot-scale machine to test the practicality and reliability of the process. Because of the pilot-scale test runs, the experiments were done on a relatively limited quantity of textile materials. The convertability of the process in each instance into large manufacturing operation on a plant scale (using conventional machinery appropriate for plant scale operation) is perfectly obvious from the short period of time required for the impregnation, quenching, rinsing and dry-heating steps. Unless otherwise indicated, parts mentioned are by volume.

EXAMPLE 1

A polymer solution was prepared as follows:
ES-7192 . . . 15 liters
WDX-743 . . . 5 liters
Carbowax-200 . . . 80 liters The contents were mixed under intense stirring for 60 minutes at 205° C. to form a stable solution.

Selected portions of a 150 denier polyester feeder yarn (in dry condition and held under a controlled tensile stress of about 4 grams) about 6 inches long in the direction of yarn travel were impregnated by padding with this polymer solution at 205° C. for about 1 second, whereas adjacent portions of the same yarn about 60 inches long were left unimpregnated, and this was repetitive. The yarn was then continuously quenched for about 0.5 second, rinsed with a solution of methyl ethyl ketone at ambient temperature for about 0.5 second and then subjected to dry-heating at 120° C. for about 1 second.

The yarn was then knitted into a double-knit fabric and then exhaust-dyed with an aqueous dyebath containing 0.5 percent of Disperse Red 91. This dyeing gas commercially attractive heather-look in the final fabric.

EXAMPLE 2

Selected portions of a 150 denier polyester feeder yarn (in dry condition and held under a controlled tensile stress of about 4 grams) were impregnated with the polymer solution of Example 1 at 205° C. for about 1 second, and this was done in a precise, controlled manner according to predetermined program. The yarn was the continuously quenched for about 0.5 second, rinsed with a solution of acetone at ambient temperature for about 0.5 second and then subjected to dry-heating at 120° C. for about 1 second.

The yarn was then knitted into a double-knit fabric and then exhaust-dyed with an aqueous dyebath containing 0.5 percent of Disperse Violet 35. This dyeing gave a commercially attractive tone-on-tone look (which is very random) in the final fabric.

EXAMPLE 3

Selected portions of a 150 denier polyester feeder yarn (in dry condition) were impregnated with the polymer solution of Example 1 at 205° C. for about 1 second when held under a controlled tensile stress of about 8 grams, and this was done in a precise, controlled manner according to a predetermined program. The yarn was then continuously quenched for about 0.5 second rinsed with a solution of methyl ethyl ketone at ambient temperature for about 0.5 second and then subjected to dry-heatng at 120° C. for about 1 second. In this manner, a definite pattern was obtained in the final yarn, with leaned 100 denier localized regions along the direction of yarn travel followed by adjacent localized regions with 150 denier (no denier charge).

The yarn was then knitted into single-knit fabric and then exhaust-dyed with an aqueous dyebath containing 0.5 percent of Disperse Blue 87. This dyeing gave commercially attractive nubby or imperfect look (which is very random) in the final fabric.

EXAMPLE 4

Selected portions of a 20/2 worsted count polyester spun yarn (in dry condition and held under a constant stress of about 5 grams), were impregnated with the polymer solution of Example 1 at 210° C. for about 1 second, and this was done in a precise, controlled manner according to a predetermined program. The yarn was then continuously quenched for about 0.5 second, rinsed with a solution of acetone at ambient temperature for about 0.5 second and then subjected to dry-heating at 120° C. for about 2 seconds.

The yarn was then woven into a velvet furniture fabric and then exhaust-dyed with an aqueous dyebath containing 0.5 percent of Disperse Red 73. This dyeing gave a commercially attractive antique or space-dyed look (which is very random in the final fabric).

EXAMPLE 5

A polymer was prepared as follows:
ES-7192 . . . 15
WDX-743 . . . 10
Diethylene Glycol . . . 75

The contents were mixed under intense stirring for 60 minutes at 185° C. so as to form a stable solution.

Selected portions of a 45/1 worsted count acrylic spun yarn (in dry condition and held under a controlled tensile stress of about 2 grams) were impregnated with this polymer solution at 185° C. for about 1 second, and this was done in a precise, controlled manner according to a predetermined program. The yarn was then continuously quenched for about 0.5 second, rinsed with a solution of methyl ethyl ketone at ambient temperature for about 0.5 second and then subjected to dry-heating at 120° C. for about 2 seconds.

The yarn was then knitted into a cardigan fabric and then exhaust-dyed with an aqueous dyebath containing 0.5 percent of Basic Red 29. This dyeing gave a commercially attractive tone-on-tone look (which is very random) in the final fabric.

EXAMPLE 6

Selected portions of a 450 denier polypropylene yarn (in dry condition and held under a controlled tensile stress of about 2 grams) about 2 inches long in the direction of yarn travel were impregnated with the polymer solution of Example 5 at 140° C. for about 1 second, whereas adjacent portions of the same yarn about 30 inches long were left unimpregnated, and this was repetative. The yarn was then continuously quenched for about 0.5 second, rinsed with a solution of acetone at ambient temperature for about 0.5 second and then subjected to dry-heating at 100° C. for about 1 second.

The yarn was then woven into a furniture fabric and then exhaust-dyed with an aqueous dyebath containing 0.5 percent of Acid Blue 40. This dyeing gave a commercially attractive heather-look on the final fabric.

EXAMPLE 7

A 70 denier polyester feeder yarn (in dry condition and held under a tensile stress of about 4 grams) was impregnated using a pair of gear (fluted metal) rolls with the polymer solution of Example 1 at 200° C. for about 1 second. The yarn was then continuously quenched for about 0.5 second, rinsed with a solution of methyl ethyl ketone at ambient temperature) for about 0.5 second and then subjected to dry-heat at 120° C. for about 1 second. In this manner, a definite wavy crimp ws obtained in the final yarn, which when knitted into a double-knit fabric gave a commercially attractive, rich silky look.

The above-mentioned processing step was repeated with a 22/1 worsted count, polyester/wool, spun yarn. A definite wavy crimp was obtained in the final yarn, which when knitted into a sweater fabric gave a commercially attractive, rich, bulky look.

What is claimed is:

1. A process for imparting novel, commercially attractive tone-on-tone or heather look to a textile material, comprising impregnating suitable localized zones of substantially dry textile matrial in a precise, controlled manner with an inert solution of polymers at a temperature in the range of 150° to 250° C., said polymers being sufficiently inert as to have no substantial adverse effect upon the textile material undergoing impregnation, said impregnation of localized zones taking place while said textile material is under tensile stress whereas other localized zones of said textile material are not subjected to said impregnation step, quenching said impregnated textile material, rinsing said quenched textile material with a relatively low boiling organic liquid, exposing said rinsed textile material to dry heat at a high temperature sufficient to remove the excess of said organic liquid from the surface of the materials, and then dyeing said textured textile material, said polymers consisting essentially of:

a. at least one phase of a copolymer of dimethyl terephthalate with a tetrol compound having the general formula:

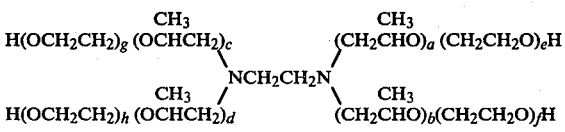

where a, b, c, d, e, f, g, and h are each integers and the total of a, b, c, and d is between 8 and 850 and the total of e, f, g, and h is between 8 and 1,000;

b. at least one phase of a compound which contains a cross-linkable polyester dispersed in a high boiling organic liquid selected from the class consisting of polyethylene and other polyalkylene glycols, and the methyl and ethylmono- and di-ethers of such glycols.

2. A process as defined in claim 1, wherein the low boiling organic liquid is an alcohol, a ketone, and an ether.

3. A process as defined in claim 1, wherein the impregnating, quenching, rinsing and dry-heating steps are carried out continuously as said textile material is fed continuously through said steps.

4. A process as defined in claim 1, wherein predetermined portions of said textile material undergoing impregnation are held under tensile stress in a precise, controlled manner to produce a varied texture contour in the final novel-textured textile material.

5. A process as defined in claim 4, wherein the impregnating, quenching, rinsing and dry-heating steps are carried out continuously as said textile material is fed continuously through said steps.

6. A novel textile material having tone-on-tone or heather-look that has been produced by the process of claim 1.

7. The novel textile material having tone-on-tone or heather-look of claim 6, wherein the textile material is in the form of a fiber, filament, multi-filament, staple fiber or slit film yarn; or a woven, nonwoven, knitted or tufted fabric.

8. The novel textile material having tone-on-tone or heather-look of claim 7, wherein the textile material is composed of synthetic thermoplastic material, fibers of natural origin, or their blends.

* * * * *

UNITED STATES PATENT OFFICE

CERTIFICATE OF CORRECTION

Patent No. 4,204,290 Dated May 27, 1980

Inventor(s) Dara A. Jilla

It is certified that error appears in the above-identified patent and that said Letters Patent are hereby corrected as shown below:

Column 1, line 38, delete "dry" and insert therefor --by--.

Signed and Sealed this

*Seventh* Day of *April 1981*

[SEAL]

*Attest:*

RENE D. TEGTMEYER

*Attesting Officer* *Acting Commissioner of Patents and Trademarks*